United States Patent [19]

Smith et al.

[11] Patent Number: 4,687,562

[45] Date of Patent: Aug. 18, 1987

[54] ANODE ASSEMBLY FOR SELECTIVELY PLATING ELECTRICAL TERMINALS

[75] Inventors: Mark L. Smith; Richard M. Wagner, both of Harrisburg, Pa.

[73] Assignee: AMP Incorporated, Harrisburg, Pa.

[21] Appl. No.: 946,401

[22] Filed: Dec. 23, 1986

[51] Int. Cl.[4] ..... C25D 5/02; C25D 17/00

[52] U.S. Cl. ..... 204/206; 204/15; 204/26; 204/224 R; 204/225; 204/280

[58] Field of Search ..... 204/206, 26, 15, 224 R, 204/225, 280

[56] References Cited

U.S. PATENT DOCUMENTS

| | | | |
|---|---|---|---|
| 3,410,781 | 11/1968 | Carlson et al. | 204/225 |
| 3,951,761 | 4/1976 | Böhringer | 204/15 |
| 4,340,449 | 7/1982 | Srinivasan et al. | 204/224 R |
| 4,364,801 | 12/1982 | Salama | 204/224 R |
| 4,384,926 | 5/1983 | Wagner | 204/26 |
| 4,405,432 | 9/1983 | Kosowsky | 204/206 |
| 4,427,498 | 1/1984 | Wagner | 204/26 |
| 4,518,474 | 5/1985 | Podini | 204/206 |
| 4,555,321 | 11/1985 | Wicks | 204/26 |
| 4,564,430 | 1/1986 | Bacon et al. | 204/224 R |
| 4,605,834 | 8/1986 | Inoue | 204/206 |

*Primary Examiner*—Arthur P. Demers

*Attorney, Agent, or Firm*—Katherine A. Nelson

[57] ABSTRACT

An anode assembly for plating contact areas within socket terminals is comprised of a conductive body member having an anode means extending forwardly from a body section, and a dielectric shroud having a profiled passageway extending axially therethrough, the dielectric shroud being removable mounted to said body section that said shroud extends coaxially around said anode means. The profiled passageway of the shroud includes a terminal receiving section which is disposed around the anode means, extends forwardly thereof, and has an inner diameter selected to be just greater than the outside diameter of a terminal to be plated. The terminal receiving section further includes lead-in means whereby a terminal members is relatively received into the terminal receiving section and locatable concentrically about the anode member.

20 Claims, 8 Drawing Figures

32
34
36
38
40
42
44
46
47
48
52
54
56
58
60
62
64
66
68
70
72
76
78
80
82
84
86
87
88
90
91
92
93
94
96
98
99
100

ANODE ASSEMBLY FOR SELECTIVELY PLATING ELECTRICAL TERMINALS

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from metal strip and are attached to a carrier strip. This carrier strip is useful for strip feeding the terminals through successive manufacturing operations. One necessary manufacturing operation involves plating, i.e., electroplating the electrical contact surfaces of the strip fed terminals with a contact metal, usually noble metals or noble metal alloys. These metals are characterized by good electrical conductivity and little or no formation of oxides that reduce the conductivity. Therefore, these metals, when applied as plating will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical anode, an electrical cathode comprised of the strip fed terminals, and a plating solution, i.e., and electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the terminals, which comprise the cathode of the plating cell. The metal ions deposit as metal plating on those terminal surfaces in contact with the plating solution.

There are disclosed in U.S. Pat. Nos. 4,384,926, 4,427,498 and 4,555,321, owned by this assignee, plating apparatuses in which the interior surfaces of strip fed terminals can be plated by supplying plating fluid through nozzles and over associated anode extensions or assemblies that are mounted for reciprocation into and out of the interiors of terminals. In effect, each anode extension, nozzle and terminal is a plating cell, the apparatus comprising a plurality of plating cells. In the first two patents, the anode extensions are mounted within their associated nozzles. In the third patent, the anode extensions are mounted separately and apart from the nozzles and enter the terminals from a different direction than that of the plating fluid.

The apparatuses disclosed in the three referenced patents are designed to be used with stamped and formed terminals, wherein the contact zone is located on an inside surface of a formed terminal. To selectively plate the contact zone the anode extension must be moved inside the terminal. To obtain an even distribution of plating in the contact zone, it is preferable that the anode member of the anode extension be concentrically aligned within the contact zone of the terminal. If the anode is not aligned concentrically in the terminal, an uneven layer of plating material is deposited. Furthermore for plating to occur, it is essential that the conductive anode member not come into physical contact with the terminal, which is the cathode. Should the anode touch the terminal, a short circuit results and no plating will occur in that cell.

To ensure accurately reproducable and uniformly deposited plating it is also necessary to precisely control the tolerances of the various components of the plating apparatus, and in particular the anode extension members. It is also important to control the tolerances in the stamped and formed terminal strips. Variations in alignment of the terminals on the strip, such as a terminal that is even slightly askew can cause the anode member to become bent and misaligned with that terminal and succeeding terminals presented to the bent anode. Furthermore, if the anode member is significantly damaged, the apparatus may jam, the strip of stock may break or the stock may have to be scrapped because of damaged terminals.

In addition to aligning the anode member within the terminal, it is also important that there be an essentially uniform current present in each of the plating cells of the plating apparatus. In each apparatus of the previous patents, electrical connection depends upon physical contact between a part of a conductive anode extension and an electrically charged member within the apparatus. This physical contact is aided by the use of spring members either in the anode extensions or the apparatus itself. Failure to achieve electrical interconnection of an anode extension causes a fluctuation in the amount of current in the remaining operating cells.

In order to minimize the aforementioned problems it is desirable to provide a means for ensuring a concentric alignment of anode members in the terminals to be plated. It is also desirable to provide means for ensuring that an essentially uniform current be "present" in each of the cells of the apparatus.

SUMMARY OF THE INVENTION

The present invention is directed to an anode assembly for plating contact areas within socket terminals. It is designed to be used in plating apparatus of the type disclosed in the U.S. patents cited above; and more particularly in the apparatus disclosed in copending U.S. patent Ser. No. 946,467 entitled *Improved Selective Plating Apparatus,* filed concomitantly herewith and incorporated by reference herein.

The anode assembly is comprised of a conductive body member having an anode means extending forwardly from a body section, a dielectric shroud member having a passageway therethrough, for receipt of the anode means, and means for securing the shroud member to the body member such that the shroud extends coaxially around the anode means. The body section includes a reference surface related to the anode means, the anode means being concentric with the reference surface and having a diameter smaller than the inner diameter of a terminal to be plated. The dielectric shroud member has a profiled passageway extending axially therethrough and includes a terminal receiving section having a forward section of said passageway extending therethrough. The forward passageway section has a diameter just larger than the outer diameter of a terminal to be plated. The shroud member includes a reference surface related to the forward passageway section and further includes a lead-in at the forward end of the forward section of said profiled passageway. The dielectric shroud is secured to the front end of the conductive body member and around the anode means, the shroud reference surface being cooperative with the conductive body reference surface such that said forward passageway section of the shroud extends coaxially around said anode means. When a socket terminal is received into the forward passageway section of the shroud, the anode means extends coaxially into a forward end of the terminal. The shroud further includes means for receiving electrolyte solution when mounted in a plating apparatus.

A further aspect of this invention is directed to a means for ensuring an electrical connection between the anode assembly and an electrically charged member of the apparatus. In the preferred embodiment, this means includes a conductive projection extending radially outwardly from a rear section of the body member, the projection having an aperture therethrough for receiving and electrically engaging one end of a conductor member; and a conductor member having one end disposed in the aperture and the other end attachable to an electrically chargable member of the apparatus.

The preferred embodiment of the anode assembly also includes a second projection in the rear body section, the second projection extending radially outwardly and in an opposite direction from said first projection. The second projection cooperates with a camming means of the apparatus to remove the anode means from the terminal.

It is an object of the present invention to provide an anode assembly for plating contact areas within socket terminals in which the anode member is concentrically disposed within the socket terminal.

It is an additional object of the present invention to provide an anode assembly with means for aligning a contact terminal for engagement with the anode of the assembly.

It is a further object of the invention to provide a means for protecting an anode member from misalignment in the terminal.

A further object of the invention is to provide a replaceable protection guide for the anode.

It is also an object to provide a means for ensuring electrical interconnection of the anode assembly with a current conducting member of a plating apparatus.

In addition, it is an object of the invention to provide a cost effective means of maintaining the anode assemblies.

Another object is to provide a means to assure positive retraction of the anode from the terminal.

A further object of the invention is to provide an anode that does not contain a spring member.

The invention itself, together with further objects and its attendant advantages, will best be understood by reference to the following detailed description, taken in conjunction with the accompanying drawings.

BRIEF DESCRIPTION OF THE DRAWINGS

FIG. 6 is a perspective view of an alternative embodiment of the anode assembly of the present invention;

DETAILED DESCRIPTION OF THE DRAWINGS

Figure 1:
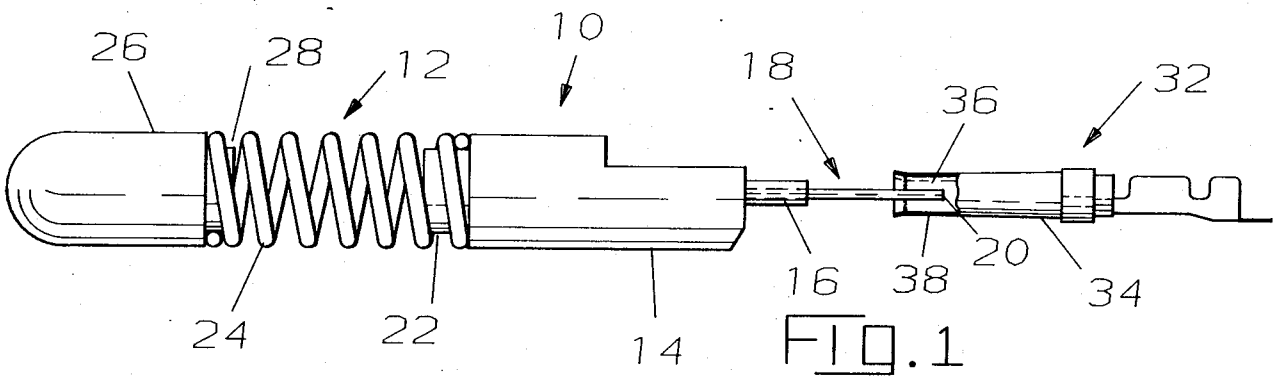
FIG. 1 PRIOR ART
FIG. 1 is a perspective view of a prior art anode assembly.
Figure 2:
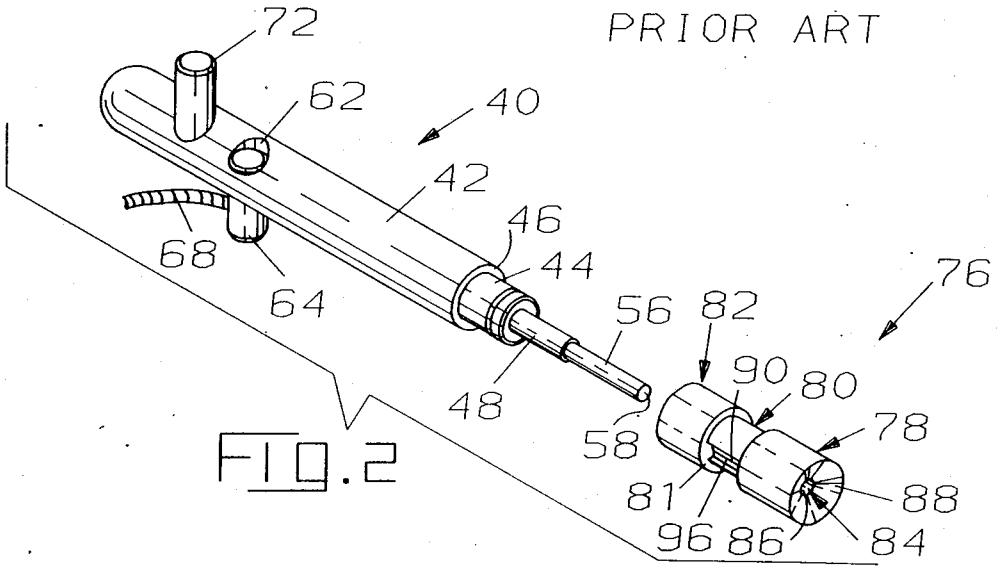
FIG. 2 is a perspective view of the anode assembly of the present invention with the parts exploded.

FIG. 1 shows an anode assembly 10 used in the prior art. The anode assembly 10 is comprised of a body member 12 and anode member 18 secured to body member 12. Body member 12 is comprised of a forward dielectric coated conductive member 14, a spring member 24 and a rear conductive member 26. Forward member 14 has reduced diameter portion 16 and conductive anode member 18 extending from a front end of portion 16. First member 14 further has an annular conductive collar 22 extending rearwardly therefrom. One end of spring member 24 is secured over collar 22. Rear conductive member 26 has a reduced diameter collar 28 extending forwardly therefrom which engages the other end of the spring member 24.

Anode assembly 10 is designed to be used with electrical terminal 32 having socket or barrel portion 34 with a passageway 36 therein. When used in a plating apparatus anode member 18 is inserted into passageway 36 of terminal member 32. In order to obtain the desired plating layer 38 inside terminal 32, it is necessary that anode member 18 be concentrically disposed within terminal 32. As can be seen in FIG. 1, the tip 20 of anode member 18 is not protected and, therefore, is vulnerable to damage should terminal 32 not be in precise alignment with anode member 18. In addition, if tip 20 is sufficiently out of alignment, it can touch the sides of passageway 36 and cause a short circuit.

Referring now to FIGS. 2 through 5, anode assembly 40 of the present invention is comprised of a conductive body member 42 having an anode member 56 extending forwardly from an end of member 42 and a dielectric shroud member 76 having a profiled passageway 84 therethrough for receipt of the anode means, 56 and means for securing the shroud member 76 to body member 42 such that shroud member 76 extends coaxially around anode member 56.

Body member 42 has a first reduced diameter section 44 extending forwardly therefrom and defining a stop surface 46, or reference surface between said reduced diameter section 44 and said body member 42. The body member 42 further has a smaller diameter anode-receiving section 48 extending forwardly from said reduced diameter section 44 and concentric therewith.

Smaller diameter anode-receiving section 48 has a coaxial bore 54 extending therethrough from front end 52 thereof. Anode member 56 is secured in bore 54 of anode-receiving section 48, preferably by crimping, although other means may also be used. Anode member 56 is dimensioned to be received within a terminal to be plated.

Body member 42 further has a first radial aperture 62 therein for receipt of a stabilization or location pin 64. Pin 64 cooperates with a location means within a plating apparatus to stabilize the position of cylindrical anode assembly 40 by preventing rotation. In the preferred embodiment, stabilization pin 64 further has aperture 66 therein for receipt of conductor wire member 68 therein. Body member 42 also has a second radial aperture 70 therein for receiving retraction pin 72. Retraction pin 72 cooperates with a camming mechanism of the plating apparatus to retract anode assembly 40 and remove anode member 56 from passageway 36 of terminal 32. For purposes of manufacturing, it is preferred that radial apertures 62 and 70 extend through body member 42 and be dimensioned to be slightly smaller than pins 64, 72. Apertures 62 and 70 can then be reamed to provide a corresponding secure interference fit with pins 64, 72 respectively. In the preferred embodiment, body member 42 is made of stainless steel and anode member 56 is platinum. Retraction pin 72 is preferably an extrudable, moldable or machineable dielectric material and in particular a dielectric material that is resistant to acids and wear, such as an acetyl resin, or high molecular weight polymers. One suitable material is Delrin ®, an acetyl resin available from E. I. Du Pont de Nemours and Company and 1900 ® UHMW from Hercules Incorporated. Other materials may also be used. Stabilization pin 64, may be made from the same material as pin 72 or may be made from a conductive material as will be explained below.

Shroud member 76 is comprised of a forward terminal receiving portion 78, middle portion 80 and rearward body receiving portion 82. Shroud member 76 further has profiled cylindrical passageway 84 extending axially therethrough. Passageway 84 has a forward portion 86 in the terminal receiving portion 78, said forward portion further having a lead-in means 88 for guiding terminal 32 into position. Forward passageway section 86 has an inner diameter selected to be just greater than the outside diameter of the terminal to be plated. Forward passageway portion 86 further has inner support portion 90 having aperture 91 extending axially therethrough for receiving anode member 56 when shroud member 76 is mounted to body member 42. Inner support portion 90 is centrally located within passageway 84 and is positioned and secured therein to form nozzles electrolyte passageway openings 93 into forward passageway 86. Support portion 90 extends axially rearwardly into middle shroud portion 80, said support portion being spaced from surfaces of said profiled passageway.

Middle portion 80 of said shroud member is reduced in diameter from forward section 78 and rearward section 82 thus forming annular recess 81. Middle section 80 further has electrolyte apertures 98 extending radially into said middle portion 80, electrolyte apertures 98 being in communication with nozzle openings 93 in forward portion 86. Nozzle apertures 98 cooperate with a corresponding electrolyte passageway in a plating apparatus and receive the electrolyte solution from the apparatus.

Passageway 84 includes a rearward section 100 having a diameter no greater than first reduced diameter section 44 of body member 42 such that shroud 76 may be removably mounted on the reduced diameter section 44 and be secured thereto through an interference fit between reduced diameter section 42 and the rearward passageway 100. Passageway 100 may also include ribs 101 for increasing the interference fit between the body and shroud members. Profiled passageway 84 further includes a small diameter passageway 98 forward of rear passageway section 100 and dimensioned for receiving the anode receiving section 48 of body member 42 when shroud 76 is mounted to body 42.

Figures 3, 4, 5:
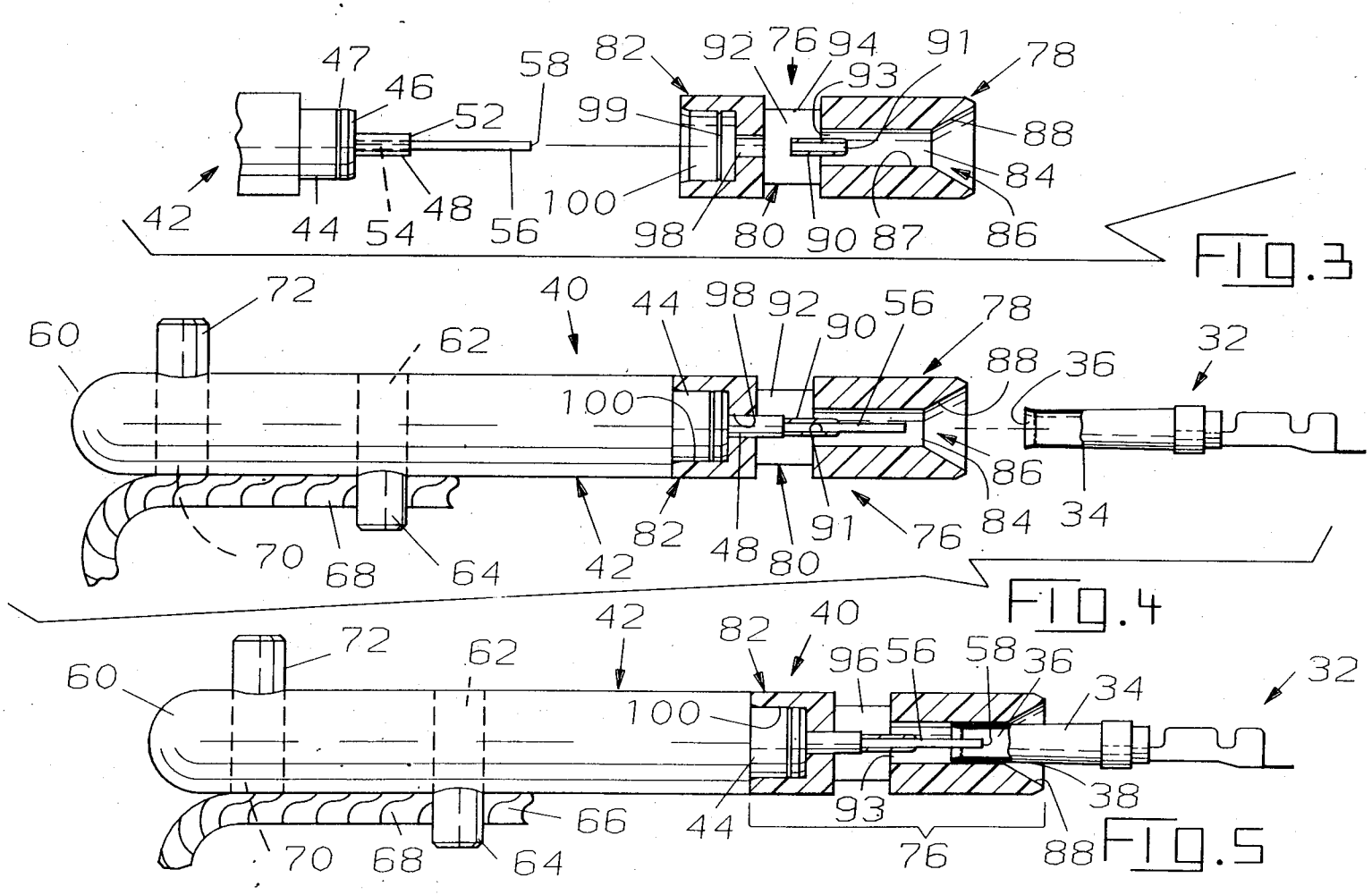
FIG. 3 is a fragmentary, partially cross-sectional exploded view of the anode assembly of FIG. 2.
FIG. 4 is a perspective partially cross-sectional view of an anode assembly in accordance with the present invention prior to insertion of the anode into an electrical terminal.
FIG. 5 is a view similar to that of FIG. 4 showing the anode positioned within the terminal.
Figure 5:
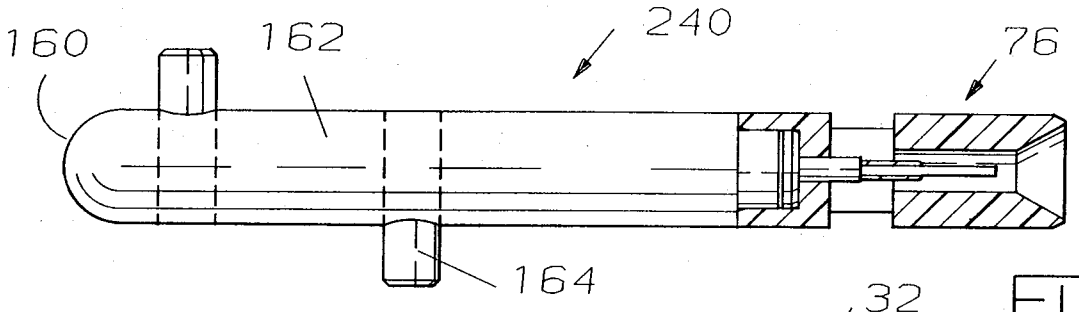

When shroud member 76 is mounted to body member 42, anode member 56 passes through aperture 91 and inner support member 90 and is held concentrically within forward passageway 86. As best seen in FIG. 4, forward terminal receiving portion 78 of shroud 76 extends beyond tip 58 of anode member 56, thereby protecting tip 58 and anode member 56 from being bent as anode member 56 is inserted into the terminal 32.

FIG. 5 illustrates the insertion of anode member 56 into terminal passageway 36. As anode assembly 40 moves forward, section 34 of terminal 32 is guided into concentric alignment with anode member 56 by lead-in means 88 which includes tapered sides 87. Sides 87 straighten terminal 32 when it is out of alignment so that the anode member 56 can enter passageway 36 and be concentric therewith. By protecting tip 58 in accordance with the invention, it is essentially impossible to have a short circuit when anode assembly 40 is moved toward terminal 32. In addition, the lead-in means of shroud 76 will guide terminals that are slightly out of alignment and protect the anode assembly and the plating apparatus from accidental damage. Positioning anode member 56 in the center of the socket contact 32 gives better plating distribution and better process control. Anode assembly 40 of the present invention provides, therefore, superior results as compared with the prior art anode of FIG. 1.

Another feature of the preferred embodiment of the present invention is means for providing a reliable and positive electrical engagement with an electrical conducting member of a plating apparatus. When this feature is utilized, stabilization pin 64 must be made from a conductive material, such as stainless steel. Pin 64 also includes aperture 66 which receives and is terminated to one end of a conductor member 68, preferably a length of essentially flexible stranded or solid wire. By attaching wire 68 to the anode assembly, it is possible to electrically connect the other end of wire 68 to a conductive member of the plating apparatus so that the current to each plating cell can be essentially identical for each of the anode members 56.

FIG. 6 shows an alternative embodiment of the anode assembly 240 in which the stabilization pin 164 is a solid member designed to be used without the positive electrical connection feature. In this embodiment anode assembly 240 must depend upon physical contact with a conductive assembly member for establishing electrical connection before plating can occur. Stabilization pin 164 may be either dielectric or conductive.

Figure 7:
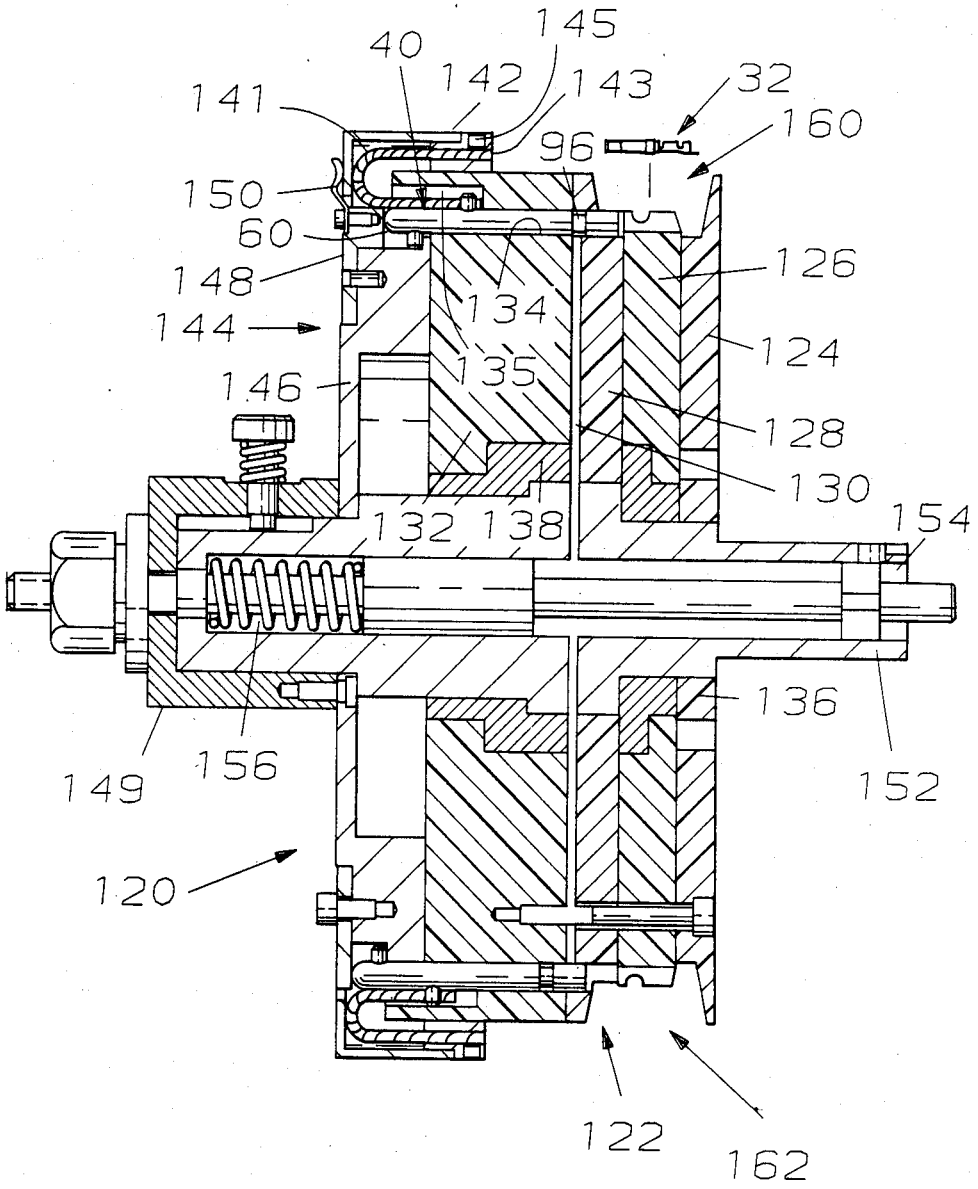
FIG. 7 is a cross-sectional view of a selective plating apparatus having the anode assemblies of the present invention mounted therein.

FIG. 7 illustrates a plating device 120 which uses anode assemblies 40 in its preferred embodiment. The details of this plating device are disclosed in U. S. patent application Ser. No. 946,267 entitled *Improved Selective Plating Apparatus* and previously incorporated herein. A mandrel plating apparatus 120 is comprised of a rotating dielectric section 122 and a stationary conductive dielectric section 144, both sections being mounted on conductive shaft member 152. Rotating dielectric section 122 is comprised of flange 124, stock drive index plate 126, nozzle and socket index plate 128 having a plurality of nozzles 130 therein, cylinder manifold 132 having a plurality of anode chambers 134 therein, and bearing members 136 and 138. In the preferred embodiment rotating section 122 further includes conductive wire collar member 140 and wire collar cover 142 mounted to the outside of cylinder manifold 128. Wire collar member 140 and cover member 142 form a plurality of cavities 141 for receiving wire 70. Wire collar member 140 has a plurality of passageways 143 therein for engaging and terminating the other end of wire 70 of anode assembly 40, wire 70 being secured by set screw 145.

Stationary conductive portion 144 of the apparatus is comprised essentially of cam base plate 146, a cam cover member 148, and collar member 149. One or more conductive spring tab members 150 are mounted to conductive cover 148 such that spring members 150 engage a portion of wire collar cover 142 to provide electrical interconnection with anode assemblies 40 through wire 70. Conductive portion 144 is mounted on conductive shaft 152. Shaft 152 further has a conduit 154 for carrying the electrolyte solution under pressure through electrolyte passageways 130 through electrolyte aperture 96 and over the anode members 56 in the anode extension assemblies 40.

A plurality of anode assemblies 40 are mounted into anode assembly chambers 134 in cylinder manifold 132. Chambers 134 include stabilization slots 135 which receive pins 64 of anode assemblies 40. Stabilization slots 135 are in communication with cavities 141 which receive wire members 70. As section 122 rotates, end 60 of the anode assemblies and retraction pin 72 are moved along a camming track formed between conductive members 146 and 148 such that essentially half of the anodes are engaged in terminals at any one time. As shown in FIG. 7, anode extensions are engaged at position 160 and retracted at position 162. The details of this mechanism are described in the above-referenced patent application.

Figure 8:
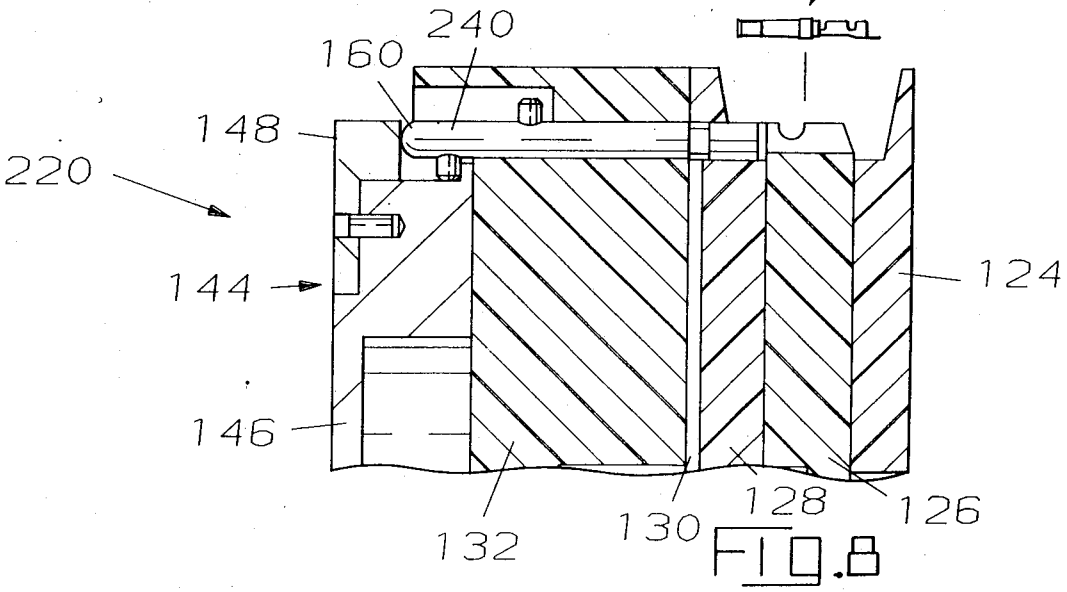
FIG. 8 is a fragmentary cross-sectional view of plating apparatus having the alternative embodiment of FIG. 6 therein.

FIG. 8 illustrates a portion of a plating apparatus 220 similar to that of 7 with the exception that there is no wire collar or wire collar cover attached to the cylinder manifold 132 to provide positive electrical interconnection. This embodiment of the apparatus is designed to be used with anode assemblies 240.

It is to be understood that the terminals, the exact shape of the anode bodies and shroud member are merely representative of the various shapes that might be used. It is further to be understood that the front of the terminal receiving portion of the shroud member may be reshaped to accommodate other terminal shapes.

It is thought that the anode assembly of the present invention and many of its attendant advantages will be understood from the foregoing description. It will be apparent that various changes may be made in the form, construction and arrangement of the parts thereof without departing from the spirit or scope of the invention or sacrificing all of its material advantages. The form herein described is merely a preferred or an exemplary embodiment thereof.

We claim:

1. An anode assembly for plating contact areas within socket terminals, comprising:

a conductive body member having an anode means extending forwardly from a body section, said body section including a reference surface related to said anode means, said anode means being concentric with said reference surface; and having a diameter smaller than the inner diameter of a terminal to be plated;

a dielectric shroud member having a profiled passageway extending axially therethrough and including a terminal receiving section and a forward passageway section extending through said terminal receiving section, said forward passageway section having a diameter just larger than the outer diameter of a said terminal to be plated, said shroud member including a reference surface related to said forward passageway section and further including a lead-in at the forward end of said profiled passageway; and means for removably securing said dielectric shroud to said front end of said conductive body member and around said anode means; said shroud reference surface cooperable with said conductive body reference surface such that said forward passageway section of said shroud extends coaxially around said anode means; whereby a said terminal is receivable into said forward passageway section of said shroud and said anode means extends coaxially into a forward end of said terminal.

2. An anode assembly as described in claim 1 wherein said body section includes a reduced diameter section and a smaller diameter anode receiving section extending forwardly from aid reduced diameter section.

3. An anode assembly as described in claim 2 wherein said body reference surface is a stop surface between said reduced diameter section and said body member.

4. An anode assembly as described in claim 2 wherein said anode receiving section further includes a coaxial bore extending therethrough from a front end thereof and said anode means is an anode member secured in said bore of said anode receiving section.

5. An anode assembly as described in claim 4 wherein said anode member is secured by crimping said anode member in said bore of said anode receiving section.

6. An anode assembly as described in claim 2 wherein said profiled passageway further includes a rearward section having a diameter no greater than the reduced diameter section of said body section, said shroud being removably mounted on said reduced diameter section.

7. An anode assembly as described in claim 6 wherein said profiled passageway further includes a smaller diameter passageway section forward of said rearward section, said smaller diameter passageway section being dimensioned to receive said anode receiving section of said body member.

8. An anode assembly as described in claim 1 wherein said profiled passageway further includes means for receiving electrolytic plating solution from a plating apparatus and means for directing said electrolytic solution over said anode means and into a terminal to be plated.

9. An anode assembly as described in claim 1 wherein said terminal receiving section of said shroud further includes an inner support portion having an coaxial bore extending therethrough for receipt of said anode means, said support means maintaining said anode means concentrically in said profiled passageway.

10. An anode assembly as described in claim 1 wherein said body member further includes means for positioning and orientating said anode assembly in a plating apparatus.

11. An anode assembly as described in claim 1 wherein said body member further includes means for terminating an electrical conductor thereto, said conductor being electrically securable to a conductive member of a plating apparatus to provide an assured electrical interconnection with said anode assembly.

12. An anode assembly as described in claim 1 wherein said shroud is removably mounted by means of an interference fit to said body member.

13. An anode assembly as described in claim 1 wherein said body member includes means for providing positive retraction said anode means from said terminal as the terminal moves out of a plating zone of a plating apparatus.

14. An anode assembly for plating contact areas within socket terminals, comprising:.

a conductive body member having a reduced diameter section extending forwardly therefrom and defining a stop surface between said reduced diameter section and said body member;

a smaller diameter anode receiving section extending forwardly from said reduced diameter section and concentric therewith and having a coaxial bore extending there through from a front end thereof;

an anode member secured in said bore of said anode receiving section, said anode member being dimensioned to be received within a terminal to be plated;

a dielectric shroud member having a profiled cylindrical passageway extending axially therethrough, said passageway including a rearward section having a diameter no greater than the diameter of said reduced diameter section, said shroud being removably mounted on said reduced diameter section, said passageway including a terminal receiving section disposed around said anode member and extending forwardly thereof, said terminal receiving section including a forward section of said profiled passageway having an inner diameter selected to be just greater than the outside diameter of a said terminal to be plated; said inner surface of said forward passageway being coaxial around said anode member, said passageway further having lead in means for said terminal member; whereby a terminal member is relatively receivable into said terminal receiving section of said shroud member and locatable concentrically about said anode member.

15. An anode assembly as described in claim 14 wherein said anode member is secured by crimping said anode member in said bore of said anode receiving section.

16. An anode assembly as described in claim 14 wherein said profiled passageway further includes a rearward section having a diameter no greater than the reduced diameter section of said body section, said shroud being removably mounted on said reduced diameter section.

17. An anode assembly as described in claim 14 wherein said profiled passageway further includes means for receiving electrolytic plating solution from a plating apparatus and means for directing said electrolytic solution over said anode means and into a terminal to be plated.

18. An anode assembly as described in claim 14 wherein said terminal receiving section of said shroud further includes an inner support portion having a coaxial bore extending therethrough for receipt of said anode means, said support means maintaining said anode means concentrically in said profiled passageway.

19. An anode assembly as described in claim 14 wherein said body member further includes means for positioning and orientating said anode assembly in a plating apparatus.

20. An anode assembly as described in claim 14 wherein said body member includes means for providing positive retraction said anode means from said terminal as the terminal moves out of a plating zone of a plating apparatus.

* * * * *